US005880706A

United States Patent [19]

Nakamura et al.

[11] Patent Number: 5,880,706

[45] Date of Patent: Mar. 9, 1999

[54] LIQUID CRYSTAL DISPLAY DEVICE WITH MATRIX ELECTRODE STRUCTURE

[75] Inventors: Koji Nakamura, Tokai; Hirotaka Suzuki, Toyota; Nobuaki Koshobu, Kariya, all of Japan

[73] Assignees: Denso Corporation, Kariya; Nippon Soken, Inc., Nishio, both of Japan

[21] Appl. No.: 770,153

[22] Filed: Dec. 19, 1996

[51] Int. Cl.[6] ..... G09G 3/36

[52] U.S. Cl. ..... 345/97; 345/96

[58] Field of Search ..... 345/94, 95, 96, 345/97, 98, 99, 100, 87, 88, 89, 208, 209, 210, 211, 212, 213

[56] References Cited

U.S. PATENT DOCUMENTS

| | | | |
|---|---|---|---|
| 5,418,634 | 5/1995 | Kambe et al. . | |
| 5,459,481 | 10/1995 | Tanaka et al. . | |
| 5,731,795 | 3/1998 | Kanda | 345/94 |

FOREIGN PATENT DOCUMENTS

| | | |
|---|---|---|
| 0564263 | 10/1993 | European Pat. Off. . |
| 0613116 | 8/1994 | European Pat. Off. . |
| 63-91634 | 4/1988 | Japan . |
| 4-311920 | 11/1992 | Japan . |
| 5-53091 | 3/1993 | Japan . |
| 5-119746 | 5/1993 | Japan . |

*Primary Examiner*—Xiao Wu
*Attorney, Agent, or Firm*—Pillsbury Madison & Sutro LLP

[57] ABSTRACT

The present invention provides a liquid crystal display device having a matrix electrode structure in which flicker of picture images displayed on a panel is invisible. Scanning electrodes of the matrix are driven by alternating voltages which include voltages for holding picture images displayed on the panel. Refresh pulse voltages higher than the holding voltages are imposed on the scanning electrodes every time the polarity of the holding voltages is reversed, so that the brightness of the picture images does not change before and after the reversing of the holding voltage polarity. In case an anti-ferroelectric liquid crystal is used as the liquid crystal, the refresh pulse voltages which cause transitions of the liquid crystal states between positive ferroelectric and negative ferroelectric states and do not cause the transition from an anti-ferroelectric state to the ferroelectric states are imposed on the scanning electrodes.

7 Claims, 16 Drawing Sheets

LIQUID CRYSTAL DISPLAY DEVICE WITH MATRIX ELECTRODE STRUCTURE

CROSS-REFERENCE TO RELATED APPLICATION

The present application is related to and claims priority from Japanese Patent Application No. Hei-7-332092, incorporated herein by reference.

BACKGROUND OF THE INVENTION

1. Field of the Invention

The present invention generally relates to liquid crystal display devices, and more particularly to a liquid crystal display device which has a matrix electrode structure to drive n×m pixels.

2. Description of Related Art

Japanese Laid-Open Patent Publication No. Hei-5-119746 describes a liquid crystal display with a matrix electrode structure. As the liquid crystal for the display, an anti-ferroelectric material is used. The anti-ferroelectric liquid crystal of this kind has at least one anti-ferroelectric state (the first stable state) and two ferroelectric states (the second and third stable states), and each of these states can be attained stably.

According to the disclosure of the above-mentioned publication, voltages applied to the liquid crystal panel are reversed periodically so that a direct current component is not applied to the panel. A transparent state of the panel is realized by using two ferroelectric states alternately, and a non-transparent state is realized by using the anti-ferroelectric state of the anti-ferroelectric liquid crystal.

The anti-ferroelectric liquid crystal panel shows different refractive anisotropies ($\Delta n$) between the two ferroelectric states when it is seen from slanting directions. Therefore, the display will flicker when the switching frequency between the two ferroelectric states becomes lower than, e.g., 30 Hz. The flicker of this kind is referred to as the slanting direction flicker. In order to eliminate the flicker, it is conceivable to choose a switching frequency which is higher than 30 Hz.

However, there is a certain limit in increasing the switching frequency in consideration of a response speed of the anti-ferroelectric liquid crystal, especially when a higher number of scanning electrodes is required to attain high definition of the display.

A proposal to prevent the slanting direction flicker has been made, for example, in Japanese Laid-Open Patent Publication No. Hei-4-311920. It proposes to switch the polarity of the applied voltage at a frequency which does not show the flicker during a holding period. However, since the holding voltage is switched or reversed at a same value, a brightness of the panel after the switching does not reach the brightness before the switching. This is because the anti-ferroelectric liquid crystal does not respond as quickly as the polarity changes. Therefore, the brightness of the panel changes every time the polarity is switched, and the flicker on the panel caused by the frequency rewriting pictures on the panel cannot be avoided.

SUMMARY OF THE INVENTION

The present invention has been made in view of the above-mentioned problems, and an object of the present invention is to provide a liquid crystal display panel which does not show the flicker when it is driven by applying an alternating voltage to the panel.

First of all, various tests have been done as to how the anti-ferroelectric liquid crystal responds to the voltages applied thereto. Generally, there are three types of the response in the anti-ferroelectric liquid crystal: when it changes from the anti-ferroelectric state to the ferroelectric state, from one of the ferroelectric states to the other ferroelectric state, and from a ferroelectric state to the anti-ferroelectric state. To attain the object of the present invention, it is necessary that the brightness of the display panel does not change when the polarity of the applied voltage is reversed during a holding period. In other words, it is required to maintain the brightness of the panel at the same level after the polarity of the applied voltage is reversed during the holding period as the level which is attained before the voltage is reversed. If this is done, the polarity of the applied voltage can be reversed during the holding period without causing the flicker.

A graph in FIG. 16 shows response time characteristics of the anti-ferroelectric liquid crystal versus voltages applied thereto. In this graph, a curve L1 shows the response time ($\tau r$) of the anti-ferroelectric state to the ferroelectric state at a temperature of 40° C., and a curve L2 shows its response time ($\tau$) when it changes from a positive ferroelectric state to a negative ferroelectric state or vice versa at 40° C. According to this graph, when 20 volts is applied, the response time ($\tau r$) is 250 $\mu$sec., and the response time ($\tau$) is 33.5 $\mu$sec. It is apparent that there is a big difference between the response time ($\tau r$) and ($\tau$).

This difference can be utilized to change the state of the liquid crystal, regions of which are in one ferroelectric state, to another ferroelectric state, while keeping regions in the anti-ferroelectric state in the same state. This means that it is possible to switch the polarity of the applied voltage during the holding period without causing a visible flicker on the display. In other words, when a refresh voltage (a recovery voltage) of 20 volts having a duration of 33.5 $\mu$sec. is applied at the time of polarity change during the holding period, only the change between the positive and negative ferroelectric states occurs without causing the change from the anti-ferroelectric state to the ferroelectric state. Thus, the visible flicker can be suppressed.

As illustrated in FIG. 17, regions of a pixel which are in one of the ferroelectric states can be changed to the other ferroelectric state by applying such a refresh voltage, while keeping regions which are in the anti-ferroelectric state unchanged. Thus, the brightness of the display can be maintained at the same level before and after the change of the polarity of the voltage applied during the holding period. This can be attained irrespective of the level of brightness, i.e., bright, dark or intermediate levels.

According to the graph of FIG. 16, when the refresh pulse of 20 volts, which is to be applied during the holding period, having a pulse width or duration in a range between the curve L1 and L2 is chosen, the brightness of the panel can be kept at the same level or the brightness change can be minimized before and after the polarity of the holding voltage is reversed. By utilizing the phenomenon mentioned above, the present invention can provide a liquid crystal display device with a matrix electrode structure in which the flicker of the display is substantially invisible.

More particularly, according to this invention, the refresh voltage higher than a holding voltage is applied to scanning electrodes at the time when the holding voltage is reversed. By applying such a refresh voltage, the brightness change of the display panel before and after reversing the polarity of the holding voltage, in which the anti-ferroelectric liquid crystal or a liquid crystal having voltage-transparency characteristics similar to the anti-ferroelectric liquid crystal is used, can be minimized. This means that the flicker of the display panel can be made invisible when it is driven by an alternating voltage.

When the anti-ferroelectric liquid crystal is used in the panel, the pulse width of the refresh voltage is chosen in such a range that the positive and negative ferroelectric states can be reversed to and from each other while the anti-ferroelectric state does not change to one of the ferroelectric states. By applying such refresh voltage at the time when the polarity of the holding voltage is reversed, a quick response in changing the states between the positive and negative ferroelectric states of the anti-ferroelectric liquid crystal can be attained.

Further, a level of signal voltages applied to a group of signal electrodes during the period in which the refresh voltage is applied to scanning electrodes is chosen at a base level of variations of the signal voltages. Because of this, signal voltages representing a bright display or a dark display are not affected by adding the base level of the signal voltages. Accordingly, a brightness of a pixel which is refreshed is not affected by signal voltages representing a brightness of other pixels on the same scanning electrode as the pixel to be refreshed.

Further, the polarity of the holding voltage of a scanning electrode is opposite to that of a neighboring scanning electrode during at least a half of a repeating cycle of a selecting period. This makes the switching frequency of the holding voltage polarity look faster than that of a field reversing method, and, accordingly, the flicker of the display due to the polarity switching is prevented.

According to the present invention, the holding voltage polarity can be alternately reversed on each of the scanning electrodes to prevent an image stick on the display without causing the flicker thereon by adding the refresh voltage to the holding voltage at every time when the holding voltage polarity is reversed.

Other objects and features of the present invention will become more readily apparent from a better understanding of the preferred embodiment described below with reference to the following drawings.

DETAILED DESCRIPTION OF THE PREFERRED EMBODIMENT

The preferred embodiment according to the present invention will be hereinafter described with reference to the accompanying drawings.

Figure 1:
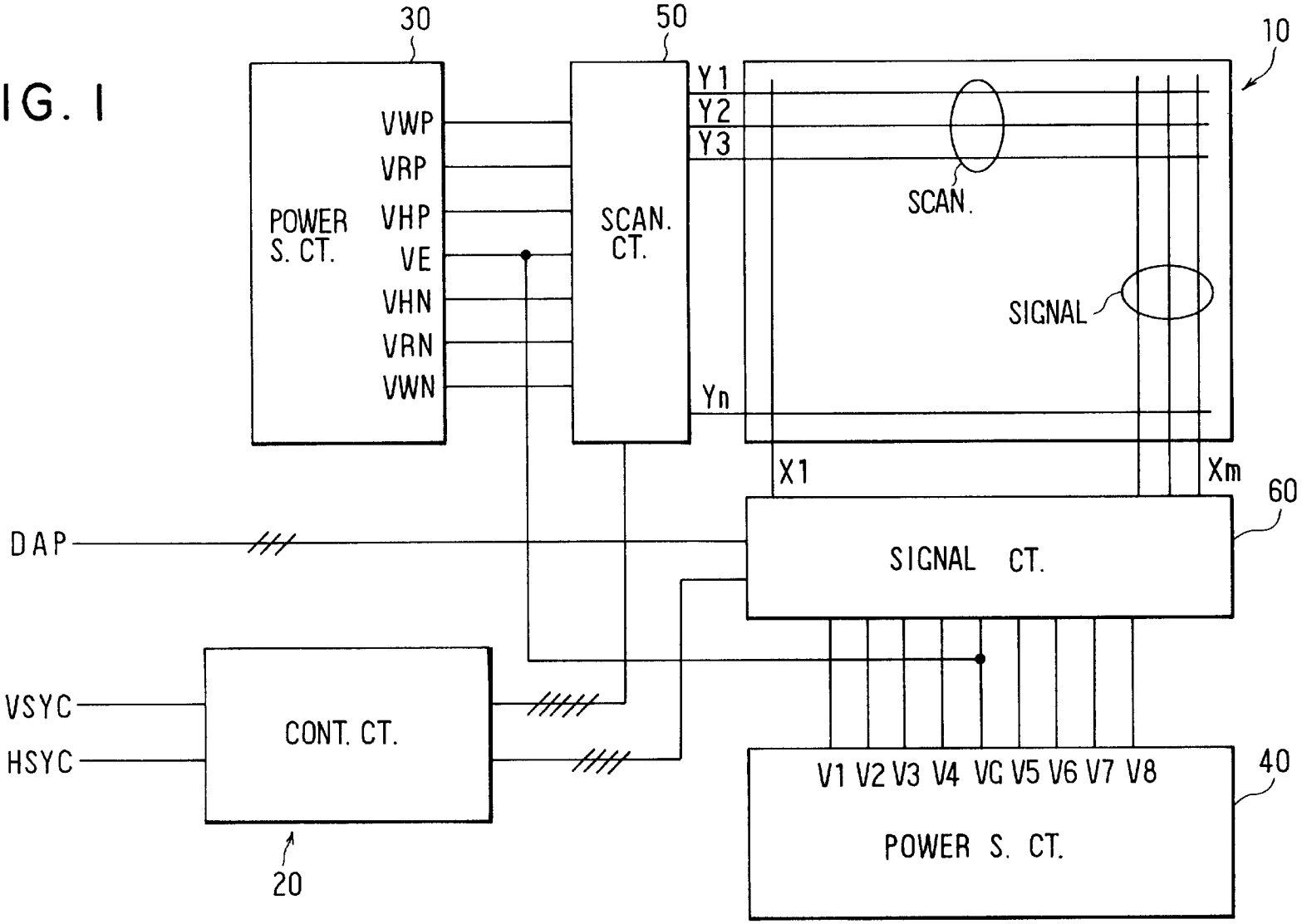
FIG. 1 is a whole structural diagram showing an embodiment of a liquid crystal display device with a matrix electrode structure according to the present invention.
Figure 2:
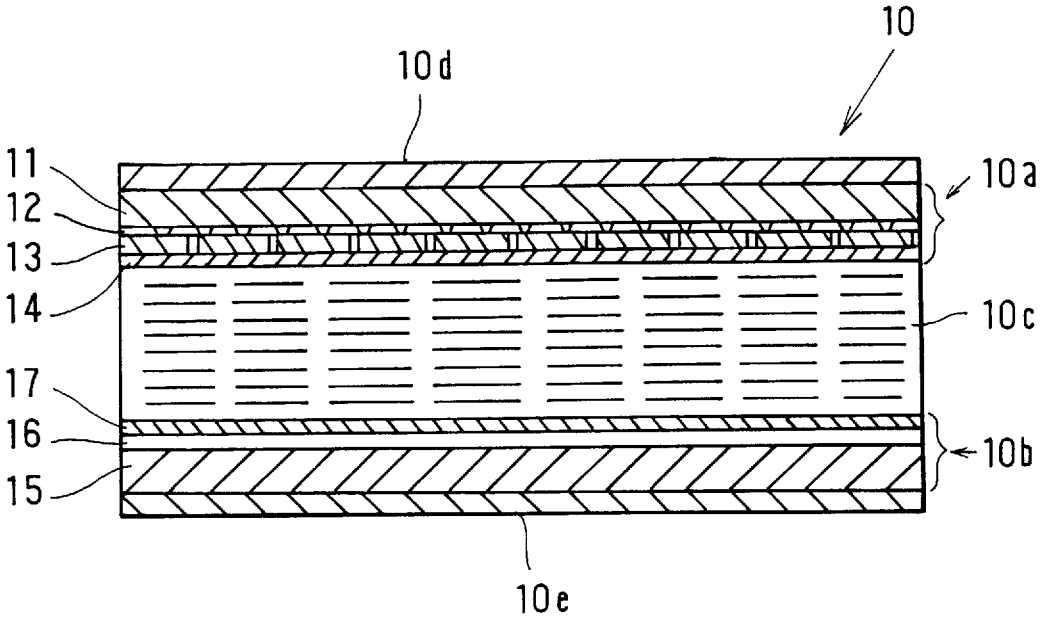
FIG. 2 is a cross-sectional view of a liquid crystal display panel.

FIG. 1 shows a whole structure of a liquid crystal display device with a matrix electrode arrangement. The device includes a liquid crystal display panel 10, as shown in FIG. 1 and FIG. 2. The display panel is composed of electrode plates 10*a* and 10*b*, an anti-ferroelectric liquid crystal 10*c* filling the space between the two plates, and two polarizer layers 10*d* and 10*e* each of which is attached to the surface of the respective electrode plates 10*a* and 10*b*.

As shown in FIG. 2, the electrode plate 10*a* is composed of: a glass substrate 11; a color filter layer 12 having m stripes of R (red), G (green) and B (blue), which is disposed on the bottom surface of the glass substrate 11; a transparent electrode layer 13 having m stripes disposed underneath the color filter layer 12; and an orientation film 14 disposed underneath the transparent electrode layer 13.

The electrode plate 10*b* is composed of: a glass substrate 15; a transparent electrode layer 16 having n stripes disposed on the glass substrate 15; and an orientation film 17 disposed on the transparent electrode layer 16.

Figure 3:
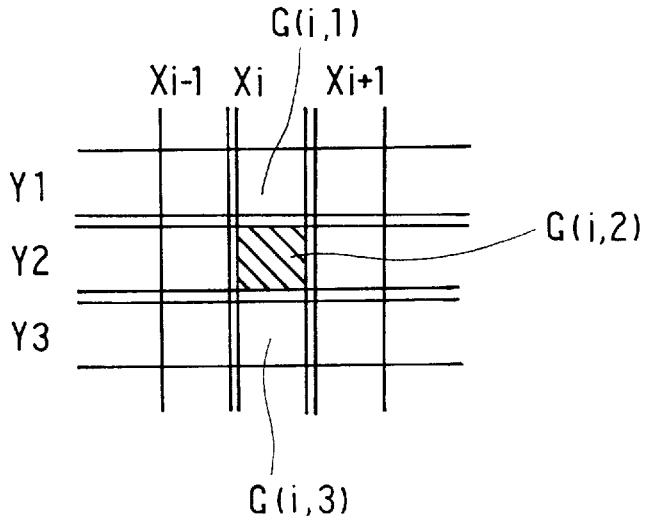
FIG. 3 is a drawing showing a model of pixels of the display panel.

The m stripes of the transparent electrode layer 13 and the n stripes of the transparent electrode layer 16 constitute an (m×n) matrix of pixels together with the anti-ferroelectric liquid crystal 10*c*, as shown in FIG. 3. The pixels, G(1,1), G(1,2) . . . G(m,n) are arranged as shown in FIG. 3. The m stripes of the transparent electrodes 13 correspond to signal electrodes, X1, X2 . . . Xm, in FIG. 1 and the n stripes of the transparent electrodes 16 correspond to scanning electrodes, Y1, Y2 . . . Yn, in FIG. 1.

The polarizer plates 10*d* and 10*e* are disposed in a cross nicol relation. Due to this arrangement, the anti-ferroelectric liquid crystal becomes non-transparent in its anti-ferroelectric state. The two electrode plates 10*a* and 10*b* are kept at a uniform distance of, e.g., 2 $\mu$m by a number of spacers not shown in the drawing.

As the anti-ferroelectric liquid crystal material 10*c*, a material such as, for example, 4-(1-trifluoromethylheptoxycarbonylphenyl)-4'-octyloxycarbonylphenyl-4-carboxylate shown in Japanese Patent Laid-Open Publication No. Hei-5-119746 can be used. Some other materials such as a mixture of several kinds of anti-ferroelectric liquid crystal or a mixture of liquid crystal materials including one kind of anti-ferroelectric liquid crystal may be used.

As shown in FIG. 1, the display device includes a control circuit 20, a power source circuit 30, another power source circuit 40, a scanning electrode driving circuit 50 and a signal electrode driving circuit 60. The control circuit 20 delivers output signals, two DPs, DR, S101, S102, SCC, LCK, STD, and SIC, while receiving a vertical synchronizing signal VSYC and a horizontal synchronizing signal HSYC from outside circuits. One of the DP signals (a first DP), DR signal, S101 signal, S102 signal and SCC signal are fed to the scanning electrode driving circuit 50. The other DP (a second DP), LCK, STD, and SIC signals are fed to the signal electrode driving circuit 60.

The S101 and S102 signals are the signals to decide a condition of the scanning electrodes, Y1, Y2 . . . Yn. In this embodiment, a condition where the S101 signal is L (low) and S102 signal is also L corresponds to an eliminating period of the scanning electrode. Similarly, when S101 is H (high) and S102 is L, the scanning electrode is in a selecting period; when S101 is H and S102 is H, the scanning electrode is in a holding period; and when S101 is L and S102 is H, the scanning electrode is in a refreshing period.

Figure 9:
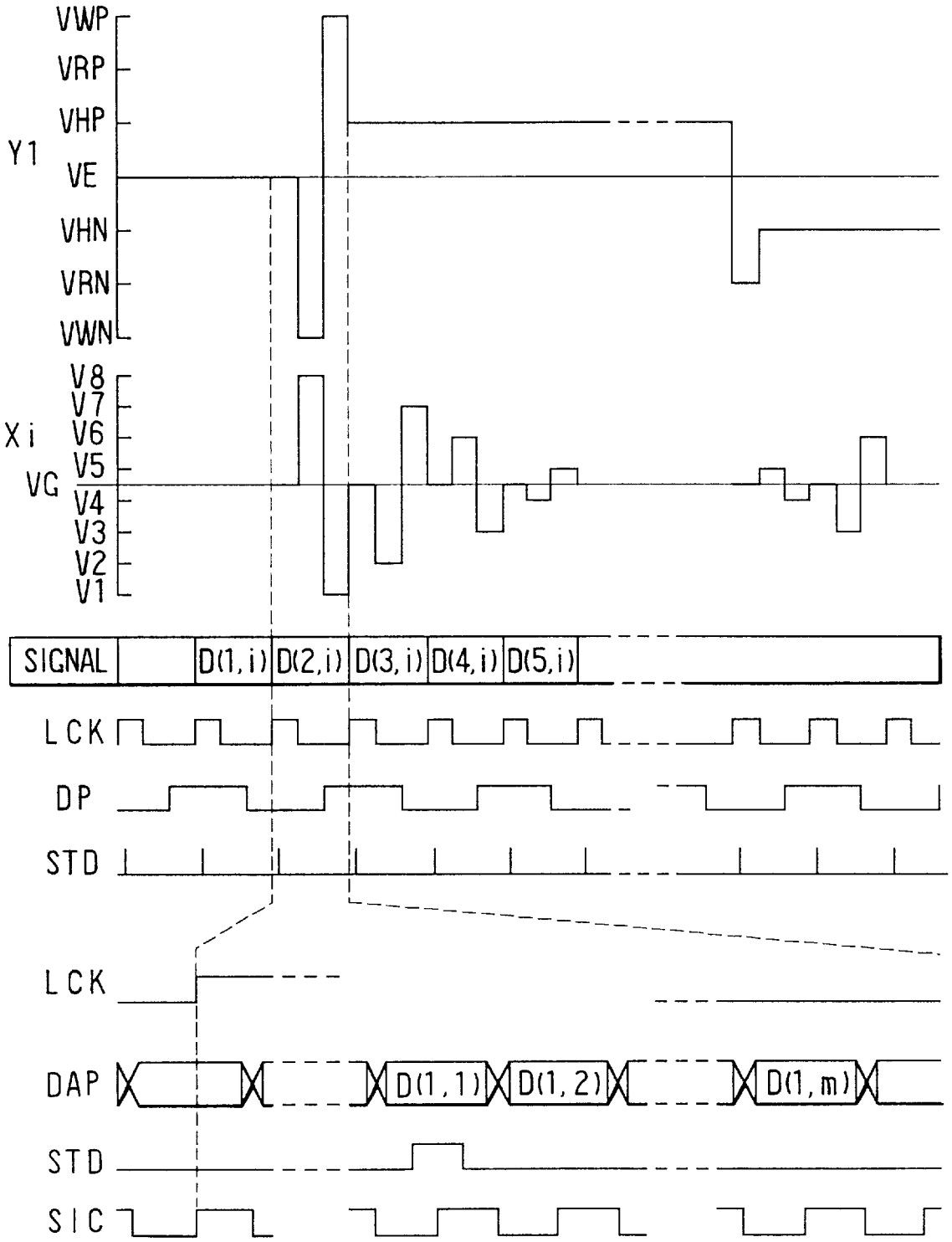
FIG. 9 is a timing chart for explaining an operation of the signal electrodes driving circuit.

The power source circuit 30 delivers seven output signals, VWP, VRP, VHP, VE, VHN, VRN and VWN, while the other power source circuit 40 outputs nine voltages for displaying eight levels of brightness, V1, V2, V3, V4, V5, V6, V7, V8 and VG (refer to FIGS. 1 and 9).

The scanning electrode driving circuit 50 supplies eight voltage levels sequentially to the scanning electrodes, Y1 . . . Yn, which correspond to the eliminating, selecting, holding and refreshing periods, based on the signals, the first DP, DR, S101, S102 and SCC from the control circuit 20. The driving circuit 50 also switches the polarity of the applied voltages at every selecting period for driving the scanning electrodes by alternating voltages (refer to FIG. 10).

Figure 10:
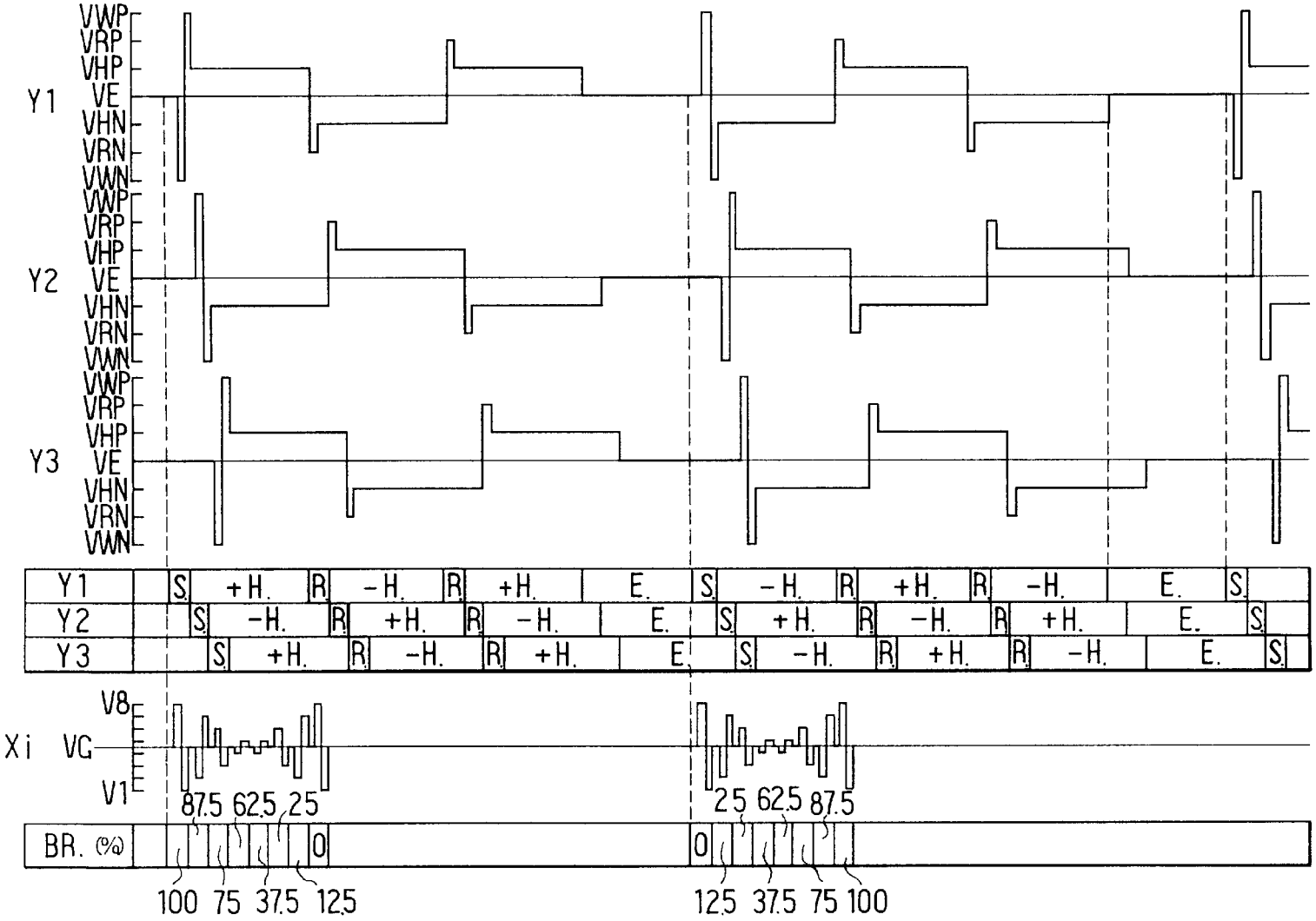
FIG. 10 is a timing chart for explaining an operation of the liquid crystal display device.

Referring to FIG. 10, operation of the scanning electrode driving circuit 50 will be explained, taking a scanning electrode Y1 as an example. During an eliminating period (E. in FIG. 10), displays on all of the pixels located on the scanning electrode Y1 are eliminated by applying the voltage VE to the scanning electrode Y1. The selecting period (S. in FIG. 10) is divided into three periods. During a positive selecting period, the voltage VE which is the same as the voltage applied during the eliminating period is applied in the first period, a negative selecting voltage VWN in the second period, and a positive selecting voltage VWP in the third period, as shown in FIG. 10. Picture image data coming from the signal electrodes are imposed on the pixels on the scanning electrode Y1 during the selecting period. In a positive holding period (+H. in FIG. 10), a positive holding voltage VHP is applied to the scanning electrode Y1 and the picture image data is maintained.

A negative refreshing period (R. in FIG. 10) is divided into two periods, a first and a second period. A negative refreshing voltage VRN is applied to the scanning electrode in the first period. The first period corresponds to a period during which a voltage VG is delivered from the signal electrode driving circuit 60 as described later, and the polarity of the holding voltage is reversed in this period while maintaining the image data as before. A negative holding voltage VHN is applied in the second period of the negative refreshing period. Then, a negative holding period (−H. in FIG. 10) follows. During the negative holding period, the negative holding voltage VHN is applied and the image data are kept as before. Then, a positive refreshing period (R. in FIG. 10) and the next positive holding period follow. The eliminating period comes again after the positive holding period.

Then, the next selecting period follows. This selecting period is a negative one as opposed to the foregoing positive selecting period. In the first period of the negative selecting period, the voltage VE is applied, and the positive selecting voltage VWP is applied in the second period. Then, in the third period the negative selecting voltage VWN is applied to the scanning electrode. The image data coming from the signal electrodes are imposed on the pixels on the scanning electrode Y1 during the selecting period. Then, the negative holding voltage VHN is applied in the negative holding period and the image data are maintained. Then, the positive refreshing period, the positive holding period, the negative refreshing period, and the negative holding period follow. These sequences are repeated thereafter.

The operation described for the scanning electrode Y1 is applied in the same manner to other scanning electrodes, Y2 . . . Yn. The scanning from the electrode Y1 through the electrode Yn is done sequentially with a phase difference of the duration of the selecting period as shown in FIG. 10. In order to prevent the flicker on the display, the polarity of neighboring scanning electrodes is alternately selected, in such a way that, for example, Y1 is positive, Y2 is negative, Y3 is positive, and so forth.

Figure 4:
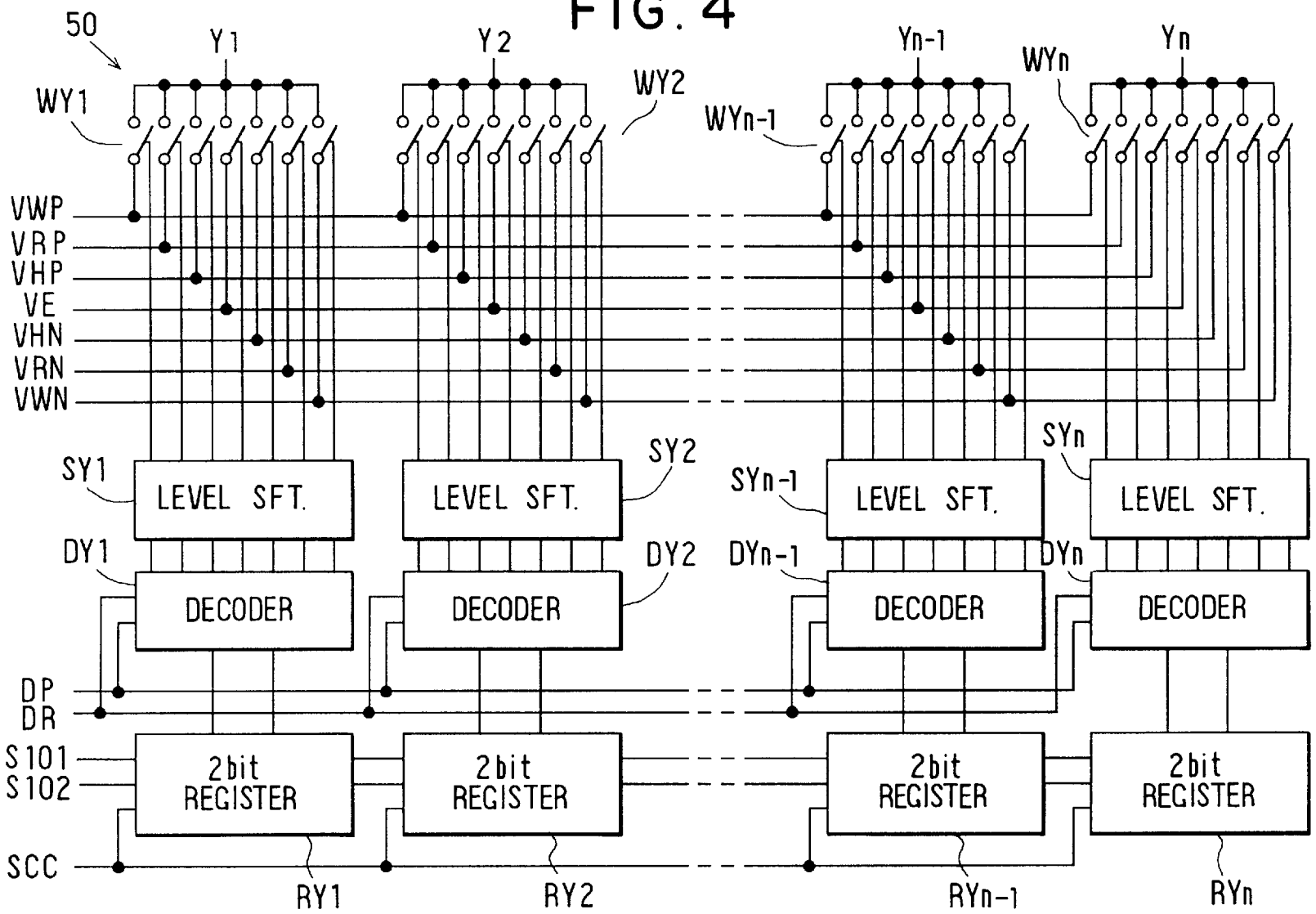
FIG. 4 is a diagram showing a scanning electrode driving circuit.

The operation of the scanning electrode driving circuit 50 will be explained referring to FIG. 4.

The scanning electrode driving circuit 50 includes n 2-bit registers (RY1, RY2 . . . RYn), n decoder circuits (DY1, DY2 . . . DYn), n level shifters (SY1, SY2 . . . SYn), and n analog switch circuits (WY1, WY2 . . . WYn). Each of the analog switch circuits includes seven analog switches. The scanning electrode driving circuit 50 performs the function mentioned above based on five kinds of signals received from the control circuit 20.

The 2-bit registers (RY1, RY2 . . . RYn) sequentially receive S101 and S102 signals from the control circuit 20 in synchronism with the rising of a SCC signal, and output 2-bit data (bit-1 and bit-2) to the decoder circuits (DY1, DY2 . . . DYn). The decoder circuits (DY1, DY2 . . . DYn) produce signals of seven kinds which perform switching operations on the analog switch circuits (WY1, WY2 . . . WYn), based on the 2-bit data from the 2-bit registers (RY1, RY2 . . . RYn) and the first DP signal and the DR signal from the control circuit 20.

Figure 5:
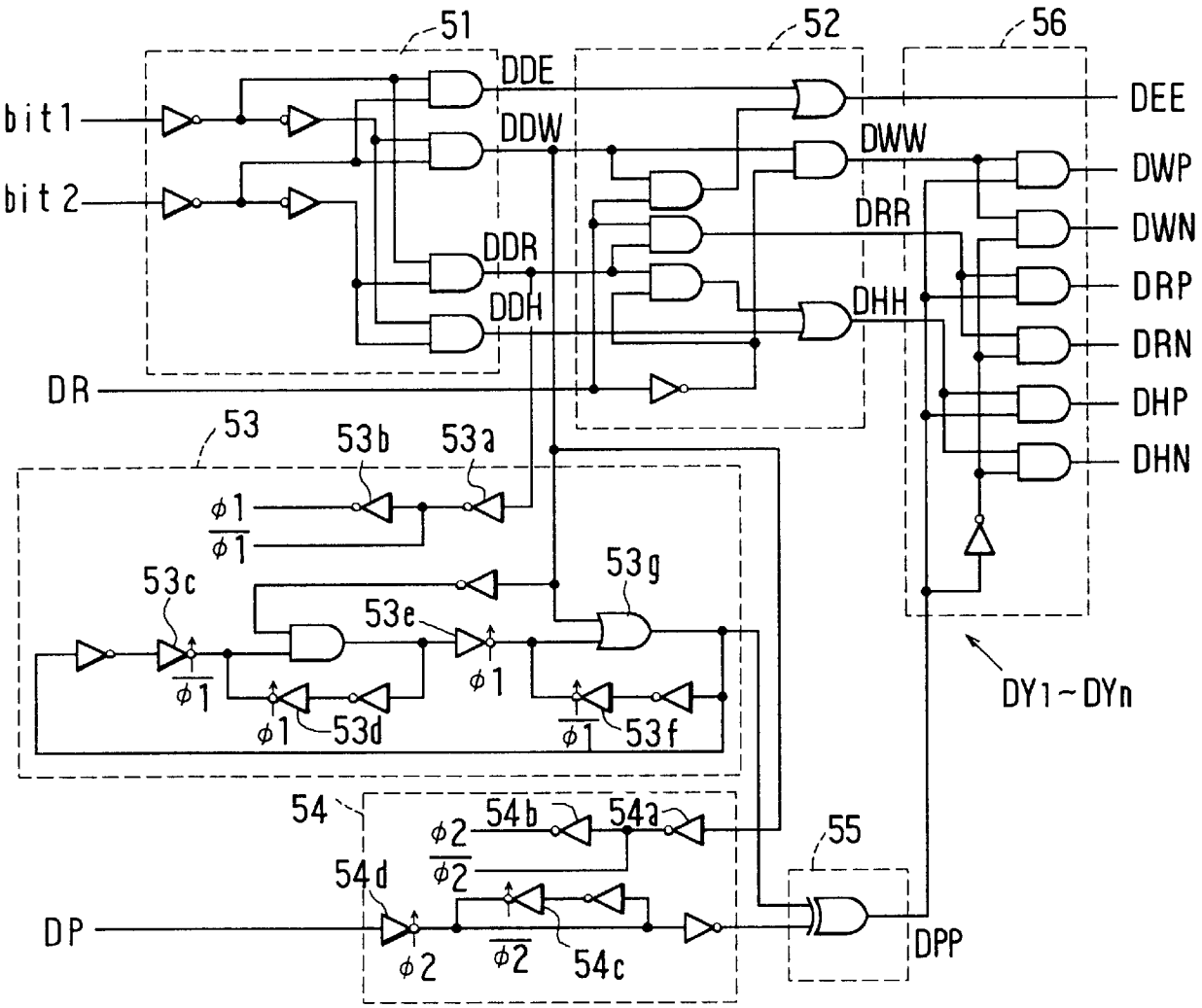
FIG. 5 is a detailed diagram showing a decoder circuit.

Each of the decoder circuits (DY1, DY2 . . . DYn) is composed as shown in FIG. 5, and has six logic circuits 51 through 56. The operation of the decoder circuit will be explained taking DY1 as an example.

The logic circuit 51 composed of four inverters and four AND gates, as shown in FIG. 5, decodes the 2-bit data (bit-1 and bit-2) received from the 2-bit register RY1, and converts them into signals, DDE, DDW, DDR and DDH which perform a switching function. During the eliminating period (S101 is L and S102 is L), only the DDE signal becomes H (high) and other signals become L (low). During the selecting period (S101 is H and S102 is L), only the DDW signal becomes H and other signals become L. During the refreshing period (S101 is L and S102 is H), only the DDR signal becomes H and other signals become L. During the holding period (S101 is H and S102 is H), only the DDH signal becomes H and other signals become L.

The logic circuit 52 composed of four AND gates, an inverter and two OR gates, as shown in FIG. 5, controls switching signals from the logic circuit 51 based on the DR signal, and outputs the signals of DEE, DWW, DRR and DHH. When the DDE signal is H, only the DEE signal becomes H. When the DDW signal is H, only the DEE signal becomes high during the time when the DR signal is H, and only the DWW signal becomes H during the time when the DR signal is L. When the DDR signal is H, only the DRR signal becomes H during the time when the DR signal is H, and only the DHH signal becomes H during the time when the DR signal is L. When the DDH signal is H, only the DHH signal becomes H.

The logic circuit 53 is composed of elements shown in FIG. 5. In the logic circuit 53, clocked inverters 53*c* and 53*f* are operated by an inverted output from an inverter 53*a*, and clocked inverters 53*d* and 53*e* are operated by a cascade output from the inverters 53*a* and 53*b*. According to the operation of the clocked inverters and other logic gates, the logic circuit 53 is reset when the DDW signal is H and reverses an output of an OR gate 53*g* in synchronism with rising of the DDR signal.

The logic circuit 54 is composed of elements shown in FIG. 5 and performs a function of latching data. In the logic circuit 54, a clocked inverter 54*c* is operated by an inverted output from an inverter 54*a* which inverts the DDW signal, and a clocked inverter 54*d* is operated by a cascade output from the inverters 54*a* and 54*b*. According to the operation of the clocked inverters and other logic gates, the logic circuit 54 outputs the first DP signal as it is when the DDW signal is H, and latches the first DP signal when the DDW signal is L.

The logic circuit 55 is composed of an exclusive OR gate and outputs an exclusive logical sum of the outputs from the logic circuits 53 and 54 as a DPP signal to the logic circuit 56. During the time when the DDW signal is H, the DPP signal corresponds to the first DP signal and its voltage polarity is controlled by the first DP signal, because the logic circuit 53 is reset and its output becomes L and the logic circuit 54 outputs the same output as the output of the logic circuit 53. When the DDW signal becomes L, the DPP signal becomes independent from the first DP signal because the logic circuit 54 performs the latch function. Since the logic output from the logic circuit 53 is reversed in synchronism with the rising of the DDR signal, the DPP signal is reversed every time the DDR signal rises and the voltage polarity is reversed at every refreshing period.

The logic circuit 56 composed of six AND gates as shown in FIG. 5 switches the voltage polarity according to the signals from the logic circuit 52 and the DPP signal from the logic circuit 55. When the DWW and DPP signals are H, the DWP signal becomes H. When the DWW signal is H and the DPP signal is L, the DWN signal becomes H. When the DRR and DPP signals are H, the DRP signal becomes H. When the DRR signal is H and the DPP signal is L, the DRN signal becomes H. When the DHH and DPP signals are H, the DHP signal becomes H. When the DHH signal is H and the DPP signal is L, the DHN signal becomes H. The seven control signals DEE, DWP, DWN, DRP, DRN, DHP, and DHN are thus synthesized.

The DEE signal controls the analog switch (refer to FIG. 4) connected to a VE terminal of the power source circuit 30 through the level shifter. The DWP signal controls the analog switch connected to a VWP terminal of the power source circuit 30 through the level shifter. The DWN signal controls the analog switch connected to a VWN terminal of the power source circuit 30 through the level shifter. The DRP signal controls the analog switch connected to the VRP terminal of the power source circuit 30 through the level shifter. The DRN signal controls the analog switch connected to the VRN terminal of the power source circuit 30 through the level shifter. The DHP signal controls the analog switch connected to the VHP terminal of the power source circuit 30 through the level shifter. The DHN signal controls the analog switch connected to the VHN terminal of the power source circuit 30 through the level shifter. When a control signal is H, a corresponding analog switch becomes closed (ON) and a corresponding voltage is supplied from the power source circuit 30 to the scanning electrode. This applies to each one of the control signals (DEE, DWP, DWN, DRP, DRN, DHP and DHN).

Figure 6:
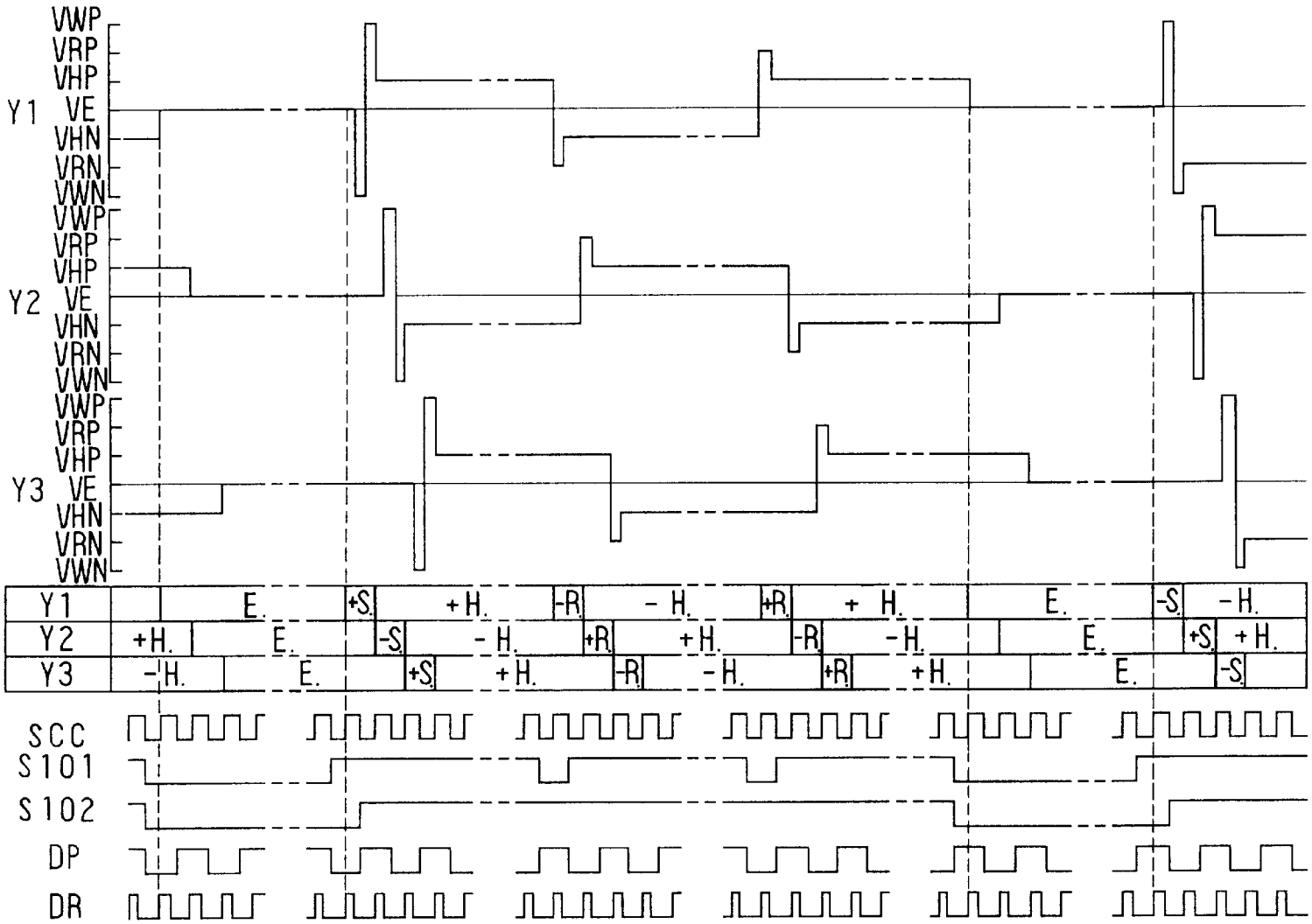
FIG. 6 is a timing chart for explaining an operation of the scanning electrode driving circuit.

Thus, voltages having a predetermined waveform as shown in FIG. 6 are supplied to each scanning electrode (Y1, Y2 . . . Yn) according to the signals SCC, S101, S102 and first DP.

Figure 7:
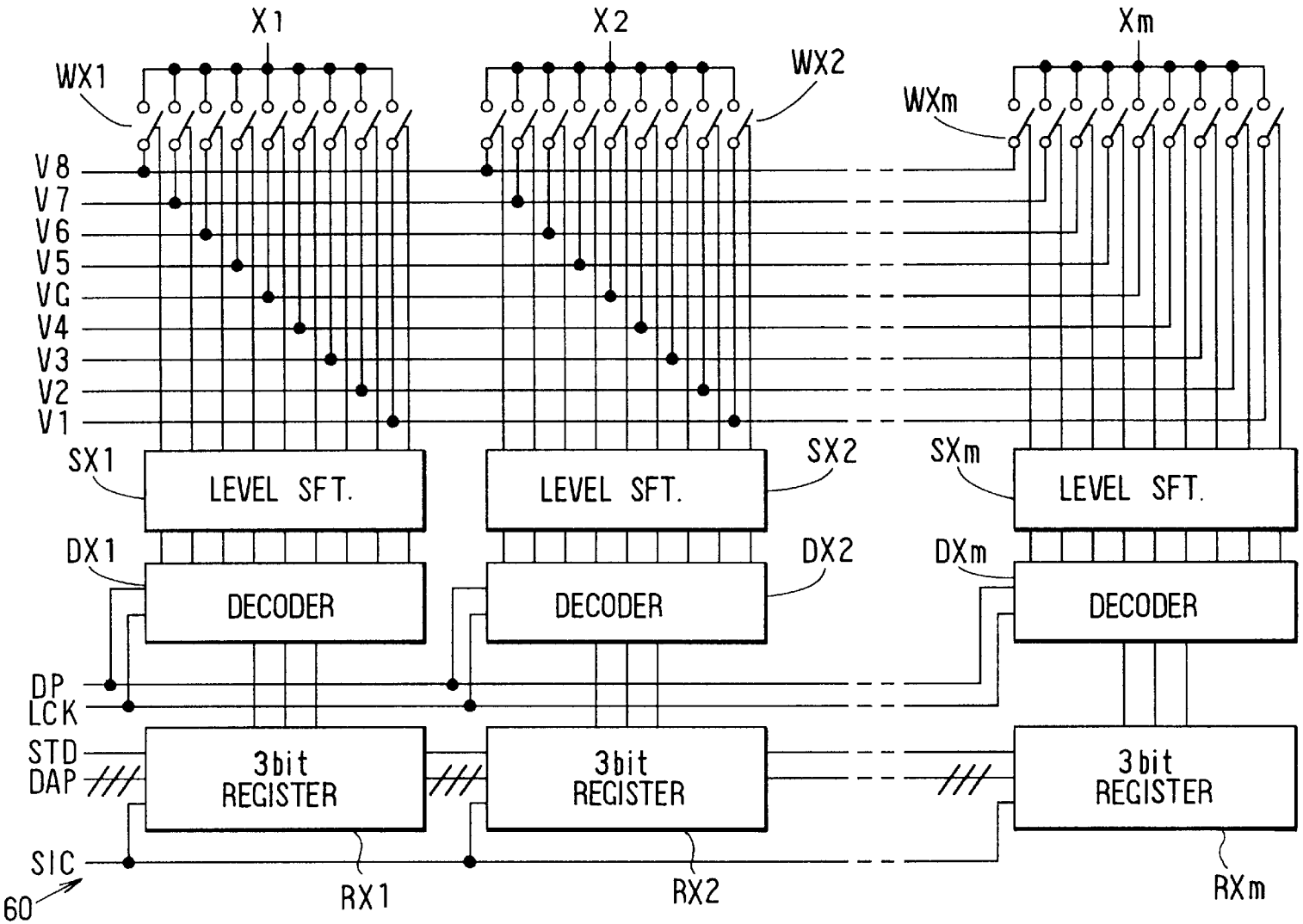
FIG. 7 is a signal electrode driving circuit diagram.

The signal electrode driving circuit 60, as shown in FIGS. 1 and 7, is composed of m 3-bit registers (RX1, RX2 . . . RXm), m decoder circuits (DX1, DX2 . . . DXm), m level shifters (SX1, SX2 . . . SXm) and m analog switches (WX1, Wx2 . . . WXm). The signal electrode driving circuit 60 supplies signal voltages of nine levels from the power source circuit 40 to the signal electrodes (X1, X2 . . . Xm) according to the picture image signal DAP from the outside and the signals, second DP, LCK, STD and SIC from the control circuit 20. The DAP signal is a 3-bit signal because the liquid crystal panel displays images having eight brightness steps.

The operation of the signal electrode driving circuit 60 will be explained referring to the timing chart shown in FIG. 9. The picture image signals DAP having 3-bit data are sent from the outside to the signal electrode driving circuit 60 as a series of data for all of the signal electrodes (X1, X2, . . . Xm). The picture image data are sent from the outside to the signal electrode driving circuit 60 sequentially, i.e., the data for the pixels on the scanning electrode Y1 come first and the data for the pixels on the scanning electrode Y2 come next, and the data come continuously in this way till the scanning electrode Yn. In FIG. 9, D(1,*i*) denotes a series of picture image data for pixels on the scanning electrode Y1, and D(1,1), D(1,2) . . . D(1,*m*), each denotes the picture image datum for the respective signal electrode, X1, X2 . . . Xm. When the STD signal is H, the picture image signal corresponding to the signal electrode X1 is fed to the 3-bit register in synchronism with the rising of the SIC signal. Similarly, the picture image signals corresponding to the signal electrodes, X2, X3 . . . Xm are sequentially fed to the 3-bit registers in synchronism with the rising of the SIC signal. Thus, the picture image data for the pixels on the one scanning electrode are stored in the 3-bit registers, RX1, RX2 . . . RXm. The data stored in the 3-bit registers are fed to the decoder circuits.

Figure 8:
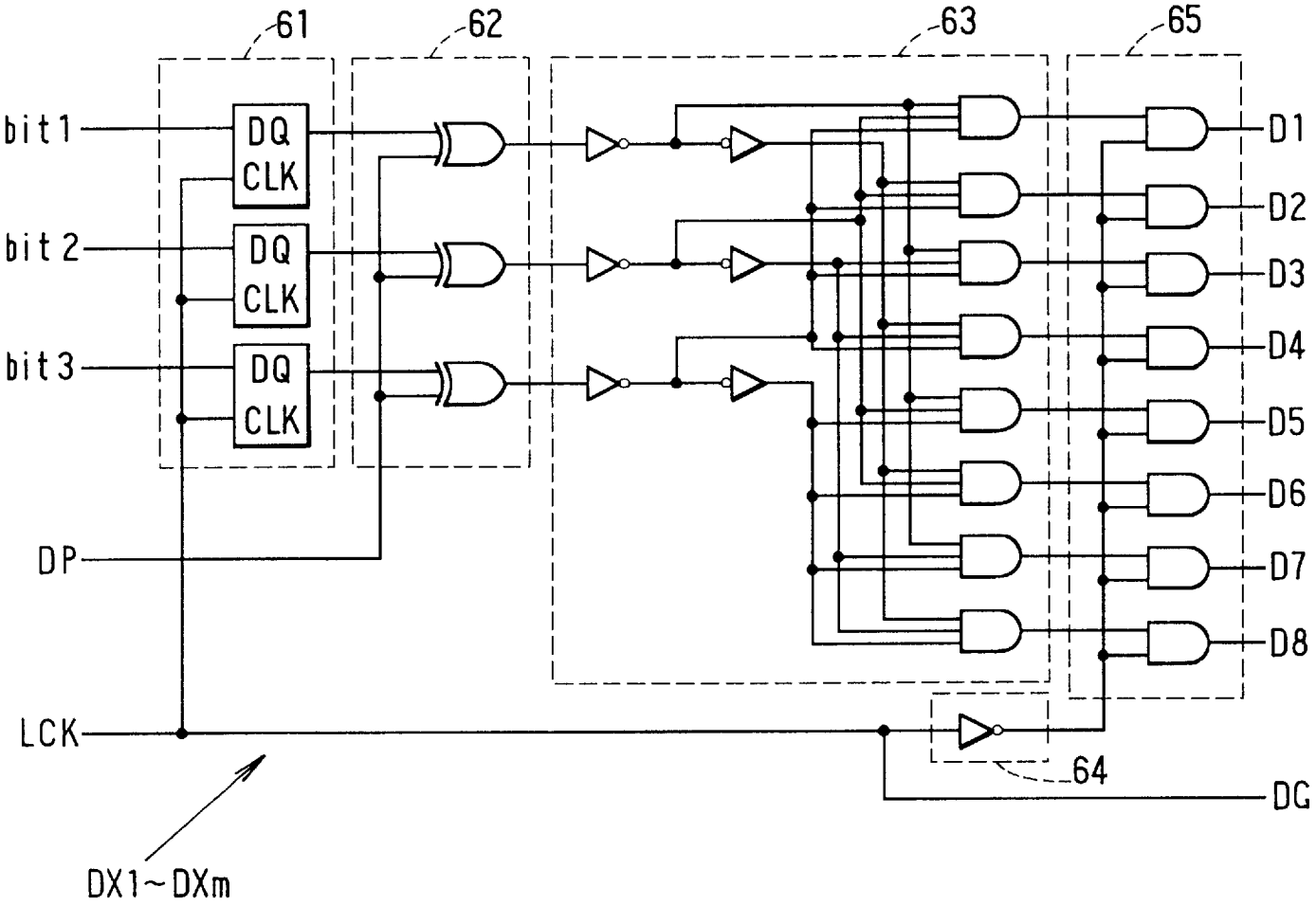
FIG. 8 is a detailed circuit diagram of a decoder.

As shown in FIG. 8, each of the decoders, DX1, DX2 . . . DXm, has five logic circuits 61, 62, 63, 64 and 65. The operation of the decoders will be explained with reference to FIG. 8, taking DX1 as an example.

The logic circuit 61 composed of three D-type flip-flops latches the 3-bit picture image data in synchronism with a rising of the LCK signal from the control circuit 20. The logic circuit 62 composed of three exclusive OR gates reverses the picture image signals latched by the logic circuit 61 when the second DP signal from the control circuit 20 is H. The logic circuit 63 is composed of three pairs of inverters and eight AND gates, and constitutes a decoder. The logic circuit 63 decodes the 3-bit picture image data signals from the logic circuit 62 and converts them to eight line outputs. The logic circuit 64 composed of an inverter reverses the LCK signal from the control circuit 20. The logic circuit 65 having eight AND gates receives signals from the logic circuit 63 and outputs control signals, Dl, D2 . . . D8, which switch the eight analog switches of the analog switch circuit WX1, according to the outputs from the logic circuit 64. Also, the decoder circuit DX1 outputs the LCK signal as a control signal DG.

The decoder circuit DX1 constituted as mentioned above makes its respective outputs, D1 through D8, high (H) when the 3-bit data latched by the logic circuit 61 are respectively (L,L,L), (L,L,H), . . . (H,H,L), (H,H,H), under the condition that the second DP signal is L and the LCK signal is L. Under the condition that the second DP signal is H and the LCK signal is L, the decoder circuit DX1 makes its respective outputs, D8 through D1, high (H) in this order when 3-bit data latched by the logic circuit 61 are respectively (L,L,L), (L,L,H), . . . (H,H,L), (H,H,H). Under the condition that the LCK signal is H, the outputs D1 through D8 become L irrespective of the 3-bit data, and only the output DG becomes H.

The outputs D1 through D8 and the output DG from the decoder control the analog switches connected to the voltages V1 through V8 and VG of the power source circuit 40, respectively, through the level shifter (refer to FIG. 7). When the outputs D1 through D8 and the output DG are H, corresponding analog switches become ON and the output voltages from the power source circuit 40 are supplied to the signal electrode.

After the picture image data for pixels on a scanning electrode are latched by the logic circuit 61 in synchronism with the rising of the LCK signal, the 3-bit registers (RX1 through RX2) begin to input the picture image data for the pixels on a next scanning electrode. Accordingly, as seen from the timing chart shown in FIG. 9, voltage outputs having prescribed waveforms are supplied to the signal electrodes X1 through Xm in response to the signals SIC, STD, LCK and second DP and picture image data DAP.

The output voltage VE from the power source circuit 30 and the output voltage VG from the power source circuit 40 are set at a common level. The signals, SCC, first DP and LCK, are synchronized with the signals, LCK and second DP, all signals being fed from the controller circuit 20. The picture image data for the pixels on a scanning electrode which is in the selecting period are input in advance by one selecting period. Thus, the waveforms shown in FIG. 10 are realized.

The operation of an example of the liquid crystal display device constructed according to the present invention, in which a one-frame display frequency is 5 Hz (a display period of one-frame is 200 ms), number of rows is 220, number of columns is 960, a scanning duty is 1/N (N=1000) and an eliminating period is E (E=100), will be explained below.

Figure 11:
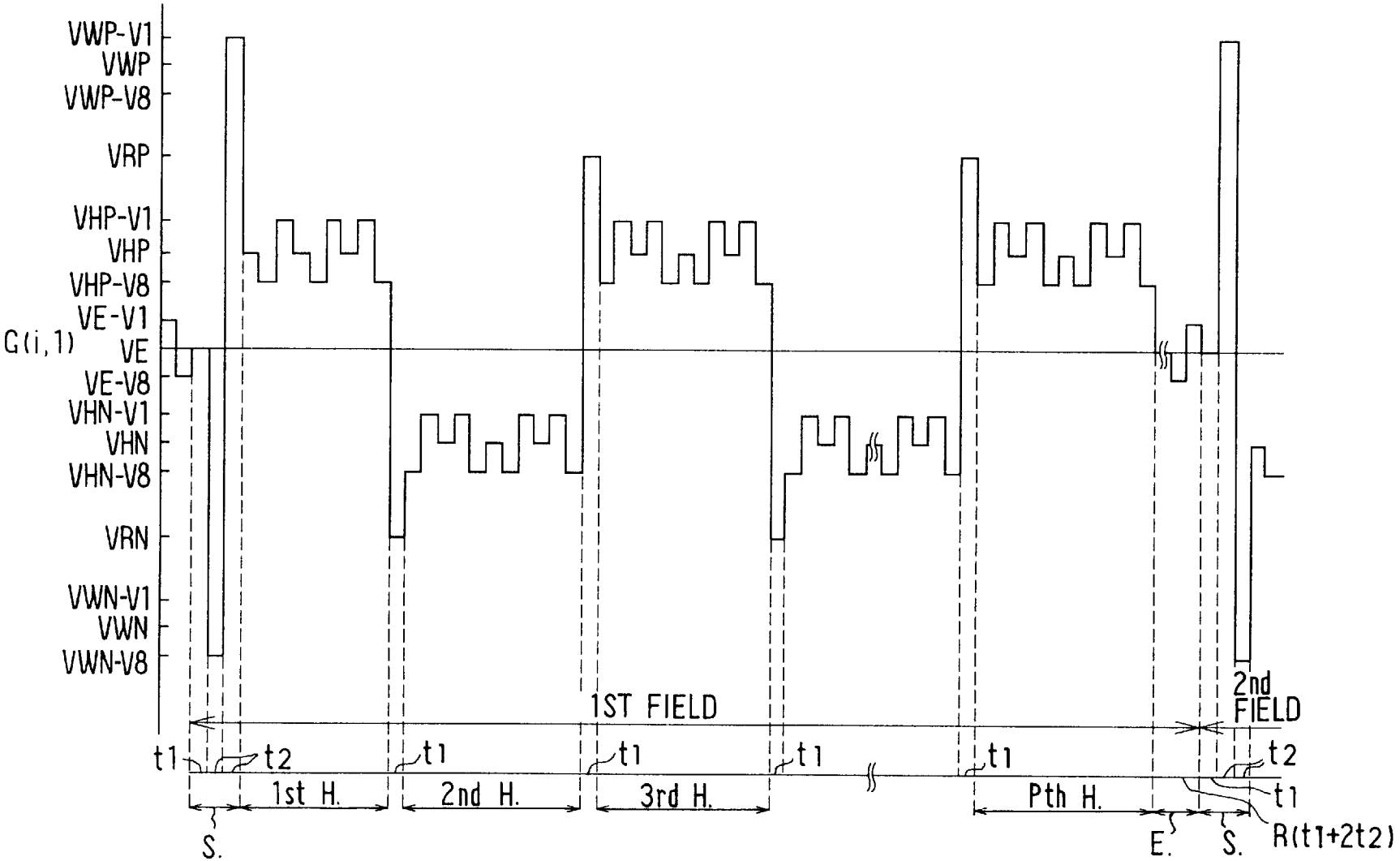
FIG. 11 is a timing chart showing waveforms of voltages applied to a pixel G(i,1) at its bright state.
Figure 12:
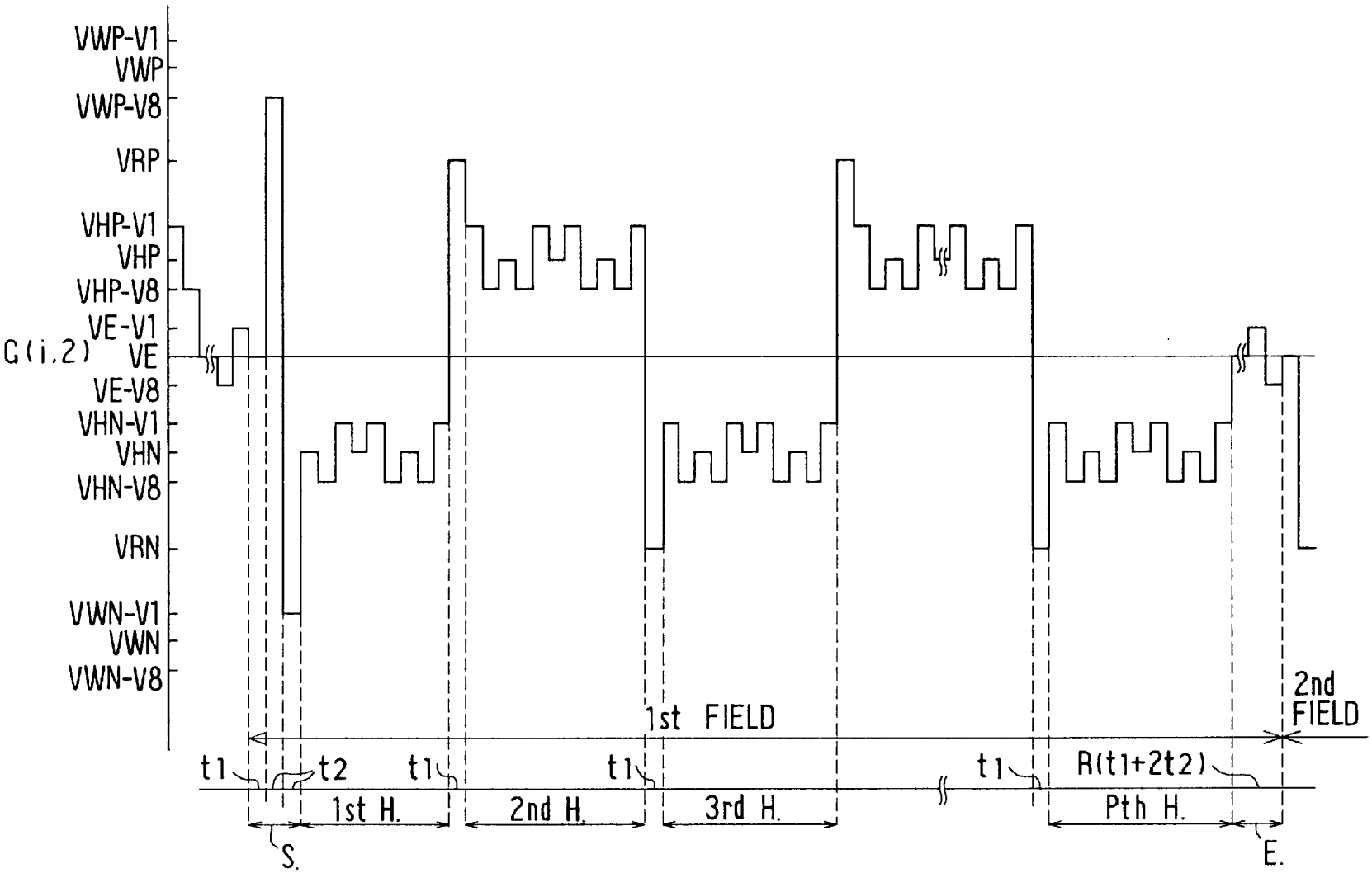
FIG. 12 is a timing chart showing waveforms of voltages applied to a pixel G(i,2) at its dark state.
Figure 13:
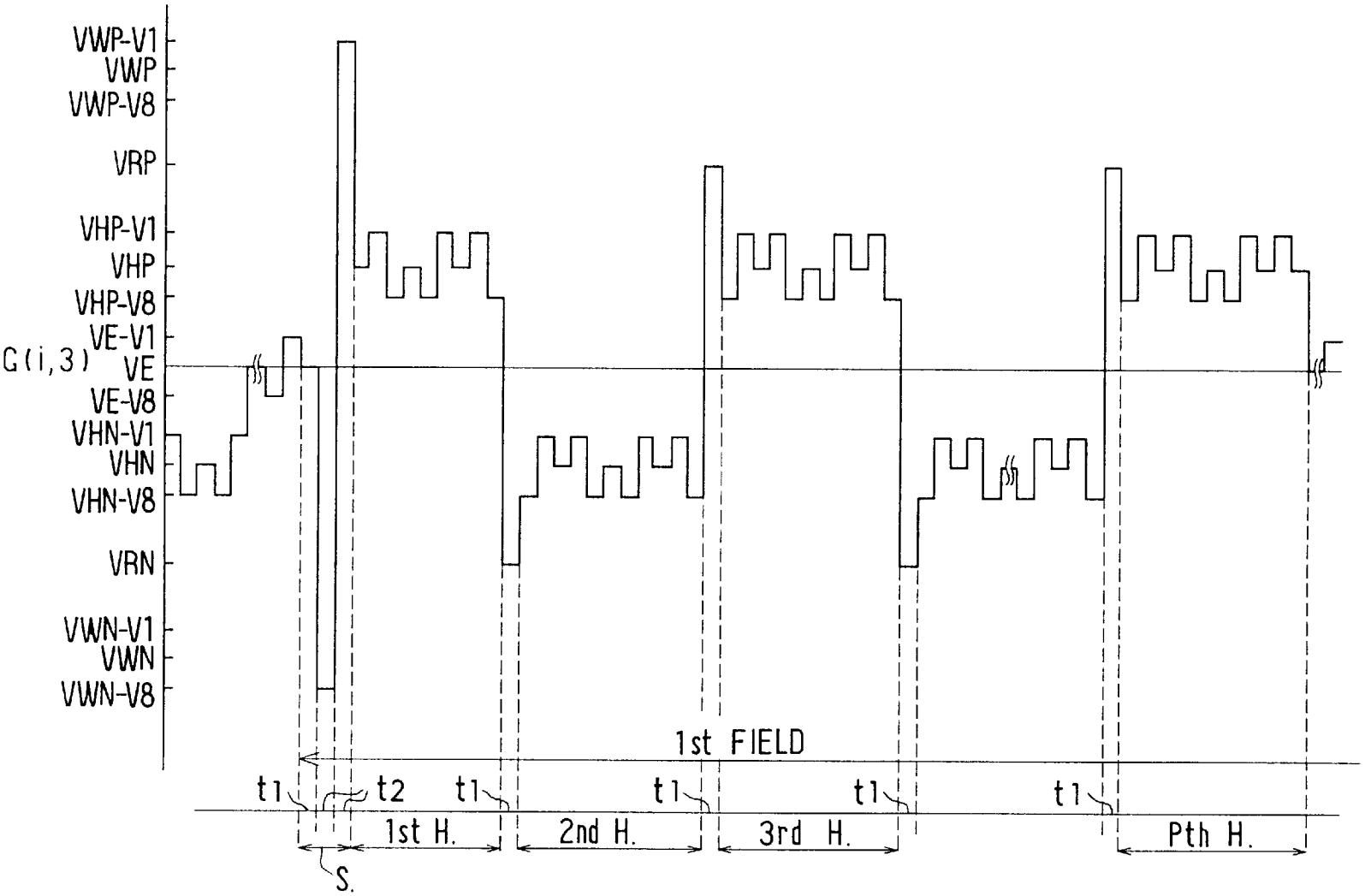
FIG. 13 is a timing chart showing waveforms of voltages applied to a pixel G(i,3) at its bright state.

To the pixels, G(i,1), G(i,2), and G(i,3), the positions of which are shown in FIG. 3 as a model, driving voltages having waveforms shown in FIGS. 11, 12 and 13 are supplied. As shown in those drawings, the driving voltages imposed on the pixels are composed of voltages of the selecting, holding and eliminating periods. The driving voltages imposed during the holding period consist of a refresh pulse voltage and a holding voltage, and the polarity thereof is reversed at a frequency more than 30 Hz. Every time the polarity is reversed, the refresh pulse is imposed. One frame of the display consists of a first field and a second field. Referring to FIGS. 11, 12 and 13, the operation of the first frame will be explained below.

First, the sequence of the driving voltage imposed to the pixels will be explained. During a selecting period, a voltage VE having a pulse width t1 (t1=33.3 μs), a voltage VWN having a pulse width t2 (t2=33.3 μs) and a voltage VWP having a pulse width t2 are sequentially imposed. During a holding period which follows the selecting period, a holding voltage VHP is imposed. After 10 ms counting from the beginning of the selecting period, a refresh voltage VRN having a pulse width t1 is imposed, and then a holding voltage VHN is imposed until 10 ms lapses counting from the beginning of the refresh voltage. Then, a refresh voltage VRP having a pulse width t1 is imposed. After that, a holding voltage VHP is imposed until 10 ms lapses counting from the beginning of the refresh voltage VRP.

Thereafter, the cycle having the refresh pulse voltage and the holding voltage is repeated every 10 ms, changing the polarity thereof. This continues until the end of the Pth holding period (P=9 in this example). The total time from the beginning of the selection period to the end of the Pth holding period is (N−E)×(t1+2×t2). Then, the voltage VE is imposed for the eliminating period, i.e., E×(t1+2×t2).

The second field is constituted by the same selecting, holding and eliminating periods as in the first field, but the polarity of all the voltages imposed is just reversed.

Next, the sequence of signal voltages imposed at the pixels will be explained. Signal voltages for the selecting period consist of three pulse voltages having a pulse width, t1, t2 and t2, respectively, in accordance with the driving voltage waveform imposed on the scanning electrodes. To display a bright image in the first field, the voltage VG with a pulse width t1 is imposed, and then the voltage V8 with a pulse width t2 and the voltage V1 with a pulse width t2 follow. To display a dark image in the first field, the voltage VG with a pulse width t1 is imposed, and then the voltage V1 with a pulse width t2 and the voltage V8 with a pulse width t2 follow. To display a bright image in the second field, the voltage VG with a pulse width t1 is imposed, and then the voltage V1 with a pulse width t2 and the voltage V8 with a pulse width t2 follow. To display a dark image in the second field, the voltage VG with a pulse width t1 is imposed, and then the voltage V8 with a pulse width t2 and the voltage V1 with a pulse width t2 follow. The image signals mentioned above determine the display condition of the pixels in combination with the waveform of the scanning voltages.

The refresh pulse voltage imposed at the beginning of the holding period to the scanning electrodes is synchronized with the signal voltage VG. That is, the refresh pulse is imposed during the period when the signal voltage is VG. Thus, it is possible to always impose the refresh voltage VRP or VRN with a pulse width t1, irrespective of any combination with image signal waveforms which display a bright image or a dark image. Accordingly, a pixel which has been refreshed can display a image with the same brightness as before without being influenced by image signal waveforms for other pixels on the same signal electrode, only the polarity of the holding voltage being reversed. The voltage imposed during the refreshing period is not necessarily limited to the voltage VG, but it may be a voltage corresponding to a base level voltage of signal voltage variation. When the base level voltage is used in stead of VG, substantially the same result can be obtained.

In order to improve angular visibility characteristics of the display, the polarity of neighboring scanning electrodes is reversed one by one, or group by group.

In the manner mentioned above, the voltages having the waveforms as shown in FIGS. 11, 12 and 13 are imposed on the pixels G(i,1), G(i,2) and G(i,3), respectively. The waveforms shown in the drawings correspond to the conditions where G(i,1) displays a bright image, G(i,2) a dark image and G(i,3) a bright image. The voltage imposed on each of those pixels is shifted in its phase by a period of (t1+2×t2). In other words, a series of voltages imposed on the pixel G(i,2) during the selecting, holding and eliminating periods is delayed in its phase by the period (t1+2×t2), compared with a series of voltages imposed on the pixel G(i,1). Similarly, the phase of the voltages imposed on following pixels are shifted by the same period.

Figure 14:
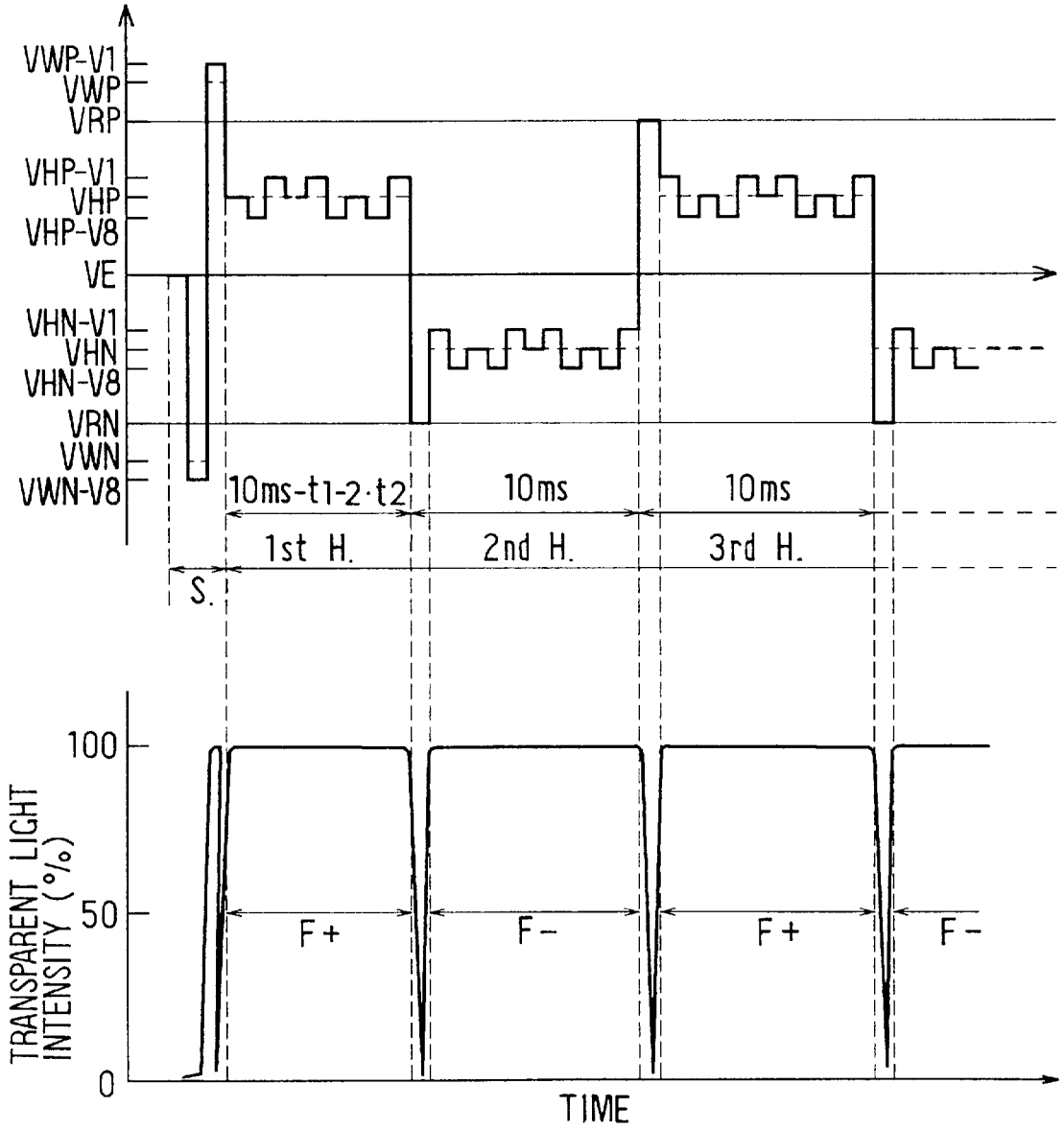
FIG. 14 is a timing chart showing waveforms of voltages applied to a pixel G(i,j) at its bright state in a first field and transparent light intensities of an anti-ferroelectric liquid crystal.

Next, the state of a pixel G(i,j) where it is in a condition to display a bright image will be explained referring to FIG. 14 which shows the voltages imposed thereon and transparent light intensities of an anti-ferroelectric liquid crystal. The driving voltage having the waveform as shown in FIG. 14 is imposed. In the selecting period of the first field, the anti-ferroelectric liquid crystal is in a second stable state (a positive ferroelectric state shown by F+ in FIG. 14), and this state continues during the first holding period which follows the selecting period. The state of the liquid crystal is switched to a third stable state (a negative ferroelectric state shown by F− in FIG. 14) from the second stable state by a refresh pulse voltage VRN with a pulse width t1 which is imposed at the beginning of the second holding period, and this state is maintained during the second holding period by the holding voltage. Then, the state of the liquid crystal is again switched to the second stable state from the third stable state by a refresh pulse voltage VRP with a pulse width t1 which is imposed at the beginning of the third holding period, and this state is maintained during the third holding period by the holding voltage. Thereafter, the switching between the second stable state and the third stable state, which is performed every time the refresh pulse voltage is imposed, is repeated. The switching frequency is chosen so that flicker of the display is not visible, for example, 50 Hz. At the end of all holding periods, the state of the liquid crystal is switched to a first stable state (an anti-ferroelectric state).

In the second field, the anti-ferroelectric liquid crystal is in the third stable state during the selecting period, and this state is maintained during the first holding period which follows the selecting period. The state of the liquid crystal is switched to the second stable state from the third stable state by the refresh pulse voltage VRP with a pulse width t1 which is imposed at the beginning of the second holding period, and this state is maintained during the second holding period by the holding voltage imposed after the refresh pulse voltage. Then, the state of the liquid crystal is switched from the second stable state to the third stable state by the refresh pulse voltage VRN with a pulse width t1 which is imposed at the beginning of the third holding period, and this state is maintained during the third holding period by the holding voltage imposed after the refresh pulse voltage. Thereafter, the switching between the second stable state and the third stable state, which is performed every time the refresh pulse voltage is imposed, is repeated. The switching frequency is chosen so that flicker of the display is not visible, for example, 50 Hz. At the end of all holding periods, the state of the liquid crystal is switched to a first stable state (an anti-ferroelectric state).

Figure 15:
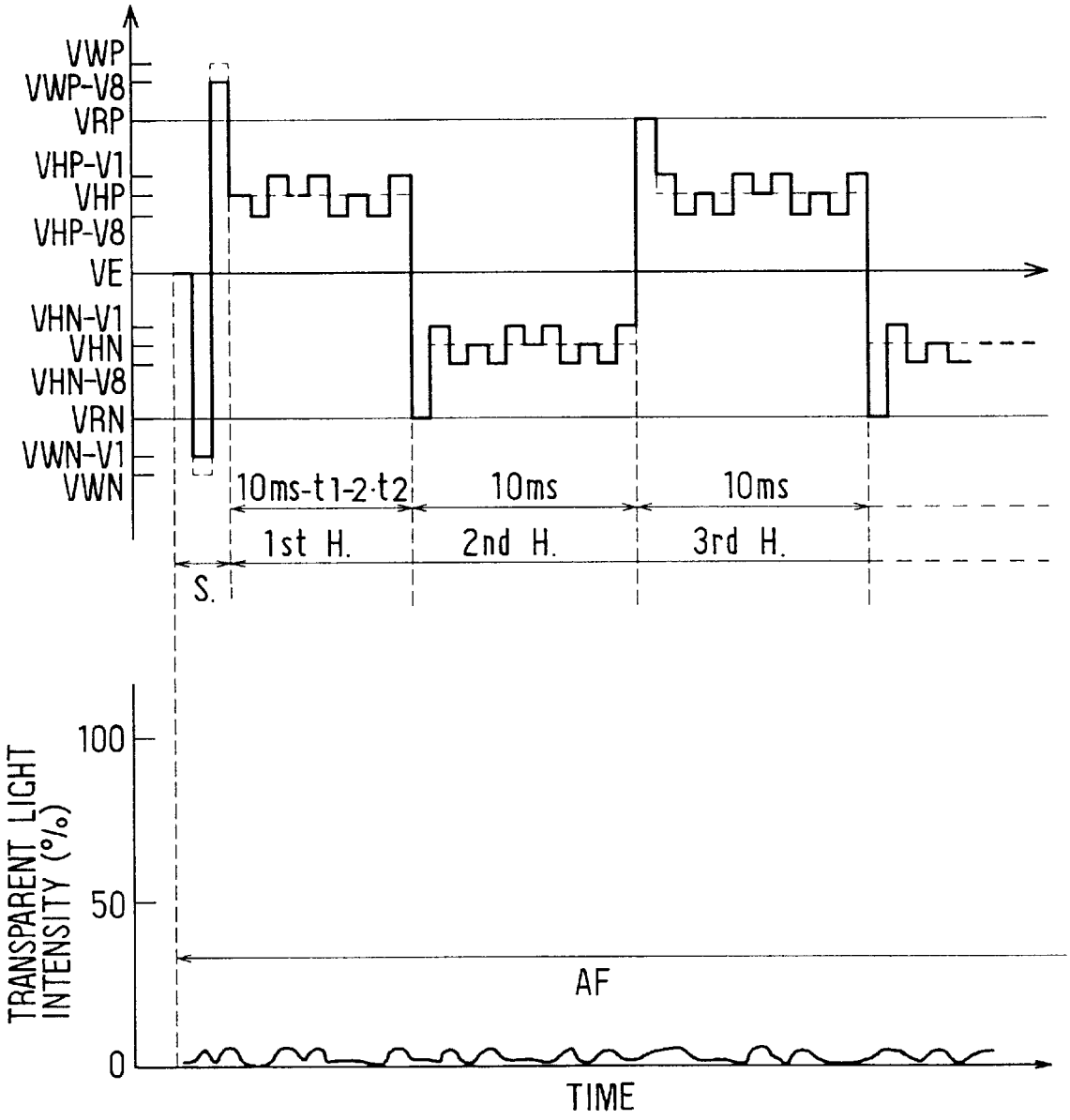
FIG. 15 is a timing chart showing waveforms of voltages applied to a pixel G(i,j) at its dark state in a first field and transparent light intensities of an anti-ferroelectric liquid crystal.
Figure 16:
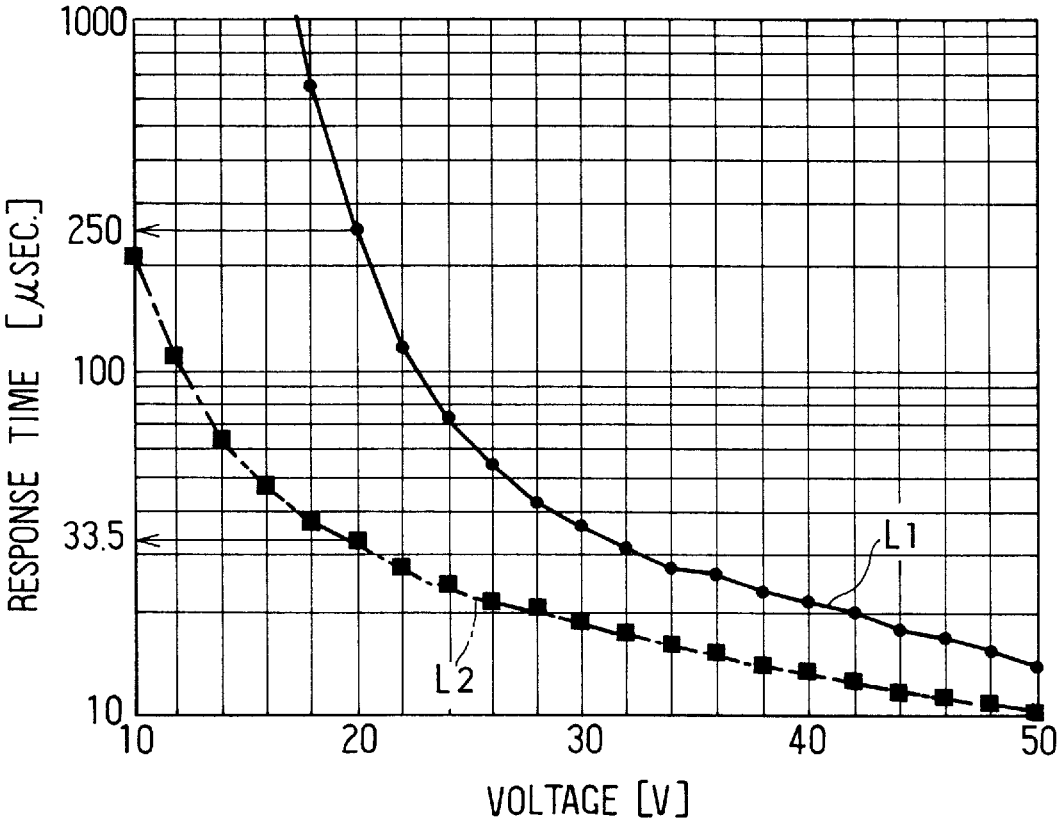
FIG. 16 is a graph showing the response time of an anti-ferroelectric liquid crystal versus voltages applied thereto.
Figure 17:
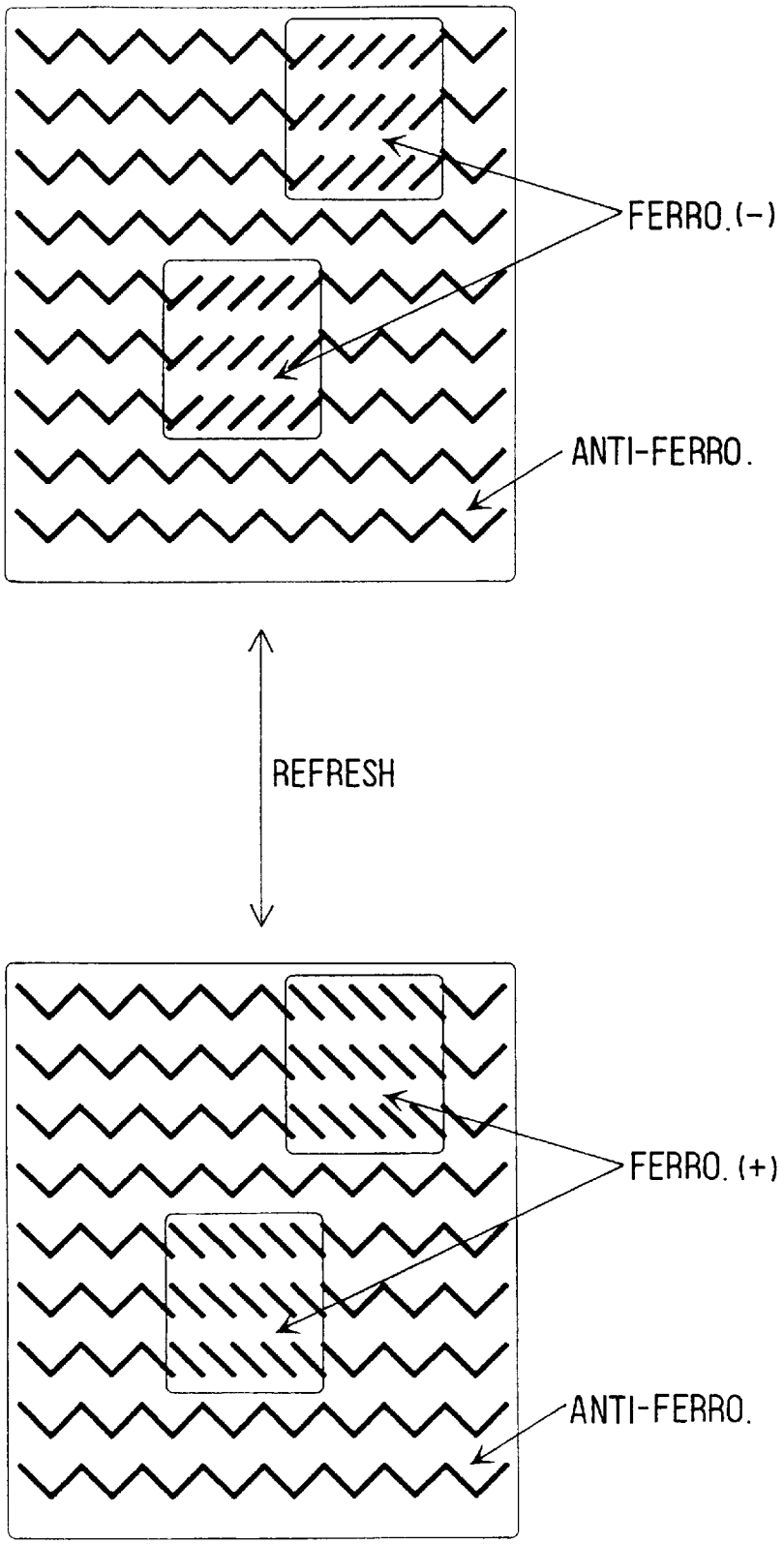
FIG. 17 is a model showing a change of states in an anti-ferroelectric liquid crystal corresponding to a pixel when a refresh voltage is applied.

Next, the state of a pixel G(i,j) where it is in a condition to display a dark image will be explained referring to FIG. 15 which shows the voltages imposed thereon and transparent light intensity of an anti-ferroelectric liquid crystal. The driving voltage having the waveform as shown in FIG. 15 is imposed. In the selecting period of the first field, the anti-ferroelectric liquid crystal is in a first stable state (an anti-ferroelectric state shown by AF in FIG. 15), and this state continues during the first holding period which follows the selecting period. The state of the liquid crystal is not switched from the first stable state to the third stable state by the refresh pulse voltage VRN with a pulse width t1 which is applied at the beginning of the second holding period, and the first stable state is maintained during the second holding period by the holding voltage. Similarly, the state of the liquid crystal is not switched from the first stable state to the second stable state by the refresh pulse voltage VRP with a pulse width t1 which is applied at the beginning of the third holding period, and the first stable state is maintained during the third holding period by the holding voltage. Thereafter, the first stable state is similarly maintained without being affected by the polarity change which occurs every time the refresh pulse voltage is imposed. Also, the liquid crystal is kept in its first stable state in the eliminating period In the second field, the anti-ferroelectric liquid crystal is in the first stable state during the selecting period, and this state is maintained during the first holding period. The state of the liquid crystal is not switched from the first stable state to the second stable state by the refresh pulse voltage VRP with a pulse width t1 which is imposed at the beginning of the second holding period, and this state is maintained during the second holding period by the holding voltage imposed after the refresh pulse voltage. Similarly, the state of the liquid crystal is not switched from the first stable state to the third stable state by the refresh pulse voltage VRN with a pulse width t1 which is imposed at the beginning of the third holding period, and this state is maintained during the third holding period by the holding voltage imposed after the refresh pulse voltage. Thereafter, the first stable state is maintained without being affected by the polarity switching which is performed every time the refresh pulse voltage is imposed. During the eliminating period, the first stable state of the anti-ferroelectric liquid crystal is kept unchanged.

As explained above, the switching between the positive and negative ferroelectric states of the anti-ferroelectric liquid crystal is performed without changing the state of pixels which are in the anti-ferroelectric state. Therefore, the display brightness does not change and is maintained in the same level before and after the polarity change of the holding voltage. Accordingly, flicker on the display is not visible and good picture images can be attained. Also, an image contrast higher than 40 was achieved at 40° C. in the embodiment according to the present invention.

The number of refresh pulse voltage impositions in one field is not necessarily limited to 8 times and can be modified to an appropriate number. The polarity of the refresh voltages imposed on a scanning electrode is chosen so that it alternates in neighboring holding periods. In this way, the anti-ferroelectric electric liquid crystal is driven by the alternating voltage, thereby preventing image stick or imprinting on the pixels.

In the embodiment disclosed herein, the polarity of the holding voltages is chosen so that neighboring scanning electrodes have an opposite polarity from each other during most of their holding periods. However, this may be modified so that neighboring scanning electrodes have an opposite polarity from each other during a period more than a half of a repeating period of the selecting period. The period during which the neighboring scanning electrodes have an opposite holding voltage polarity from each other can be decided according to the number of the refresh pulse impositions.

According to the present invention, the polarity switching frequency of the holding voltage looks higher for viewers, compared with a field reversing method. Accordingly, while attaining the advantage resulting from the imposition of the refresh pulse voltage, the flicker on the display caused by the switching of the holding voltage polarity can be prevented at the same time.

The construction of the logic circuits in the embodiment mentioned above may be replaced by programmed routines of a microprocessor.

What is claimed is:

1. A liquid crystal display device comprising:

a liquid crystal display panel having n×m pixels constituted by a matrix electrode structure having n stripes of scanning electrodes and m stripes of signal electrodes;

scanning electrode driving means for imposing scanning voltages sequentially on the scanning electrodes, the means providing a selecting period during which picture images are written on the pixels and a holding period during which the picture images are maintained by a holding voltage, a polarity of which is reversed at least one time; and signal electrode driving means for imposing signal voltages representing the picture images sequentially on the signal electrodes in synchronism with the scanning voltages, thereby displaying picture images on the display panel; wherein:

a refresh pulse voltage which is higher than the holding voltage is imposed on the scanning electrodes at the time the polarity of the holding voltage is reversed.

2. A liquid crystal display device according to claim 1, wherein a liquid crystal used in the liquid crystal display panel is an anti-ferroelectric liquid crystal which exhibits an anti-ferroelectric state, a positive ferroelectric state and a negative ferroelectric state according to voltages imposed thereon; and a pulse duration of the refresh pulse voltage is longer than a period in which the anti-ferroelectric liquid crystal changes its states between the positive and negative ferroelectric states and shorter than a period in which the anti-ferroelectric liquid crystal changes its states from the anti-ferroelectric to ferroelectric states.

3. A liquid crystal display device according to claim, 1 or 2, wherein a base level voltage of picture image data variations is imposed on the signal electrodes during a period in which the refresh pulse voltage is imposed on the scanning electrodes.

4. A liquid crystal display device according to claim 1 or 2, wherein:

the polarities of the holding voltages imposed on neighboring scanning electrodes are opposite from each other during a period more than a half of a repeating period of the selecting period.

5. A liquid crystal display device according to claim 3, wherein:

the polarities of the holding voltages imposed on neighboring scanning electrodes are opposite from each other during a period more than a half of a repeating period of the selecting period.

6. A liquid crystal display device according to claim 1, wherein:

a polarity of the holding voltage imposed on any one of the scanning electrodes at an end of a holding period is opposite to a polarity of the holding voltage imposed on the same scanning electrode at a beginning of an immediately following holding period.

7. A liquid crystal display device according to claim 1, wherein:

a liquid crystal used in the liquid crystal display panel is an anti-ferroelectric liquid crystal which exhibits an anti-ferroelectric state, a positive ferroelectric state and a negative ferroelectric state according to voltages imposed thereon; and the refresh pulse voltage imposed on the scanning electrodes has such a level and a duration that the refresh pulse voltage causes transitions of the state of the anti-ferroelectric liquid crystal between the positive and negative ferroelectric states and does not cause the transition from the anti-ferroelectric to ferroelectric states.

* * * * *